United States Patent [19]

Bittel

[11] 4,082,201

[45] Apr. 4, 1978

[54] TWO-PIECE END CLOSURE WITH ASSEMBLY DEVICE

[75] Inventor: Patricia A. Bittel, Bay Village, Ohio

[73] Assignee: Weatherchem Corporation, Twinsburg, Ohio

[21] Appl. No.: 776,549

[22] Filed: Mar. 11, 1977

[51] Int. Cl.[2] ..... B65D 43/14; B65D 51/04

[52] U.S. Cl. ..... 220/339; 220/306; 220/375; 220/269; 215/306

[58] Field of Search ..... 220/269, 306, 334, 338, 220/266, 339, 375; 215/306; 222/153, 541

[56] References Cited

U.S. PATENT DOCUMENTS

| | | | |
|---|---|---|---|
| 3,651,992 | 3/1972 | Hazard | 220/338 X |
| 3,899,285 | 8/1975 | Christmas | 220/339 X |
| 3,998,354 | 12/1976 | Song | 220/339 X |

*Primary Examiner*—George T. Hall

*Attorney, Agent, or Firm*—McNenny, Pearne, Gordon, Gail, Dickinson & Schiller

[57] ABSTRACT

A two-piece end closure for a container includes a stationary base and a recloseable cap. The base includes a through opening for dispensing the contents of the container and an annular trough extending substantially 360° around the opening. The cap includes a cover portion extending over the opening, an elongated attachment leg frictionally received in the trough, and a flexible connecting wall extending between the cover portion and the lug.

11 Claims, 7 Drawing Figures

Fig. 1
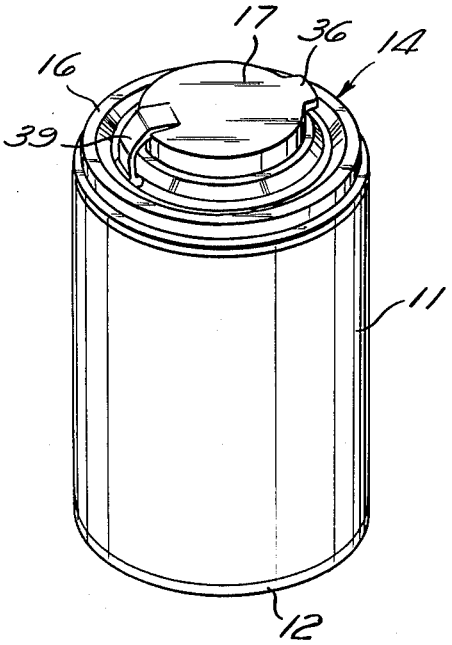
Fig. 2
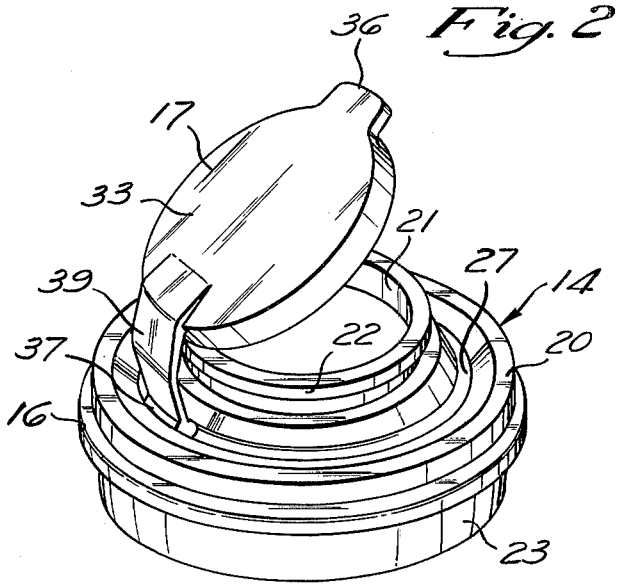
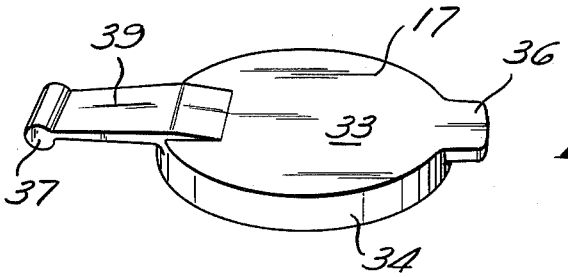
Fig. 3
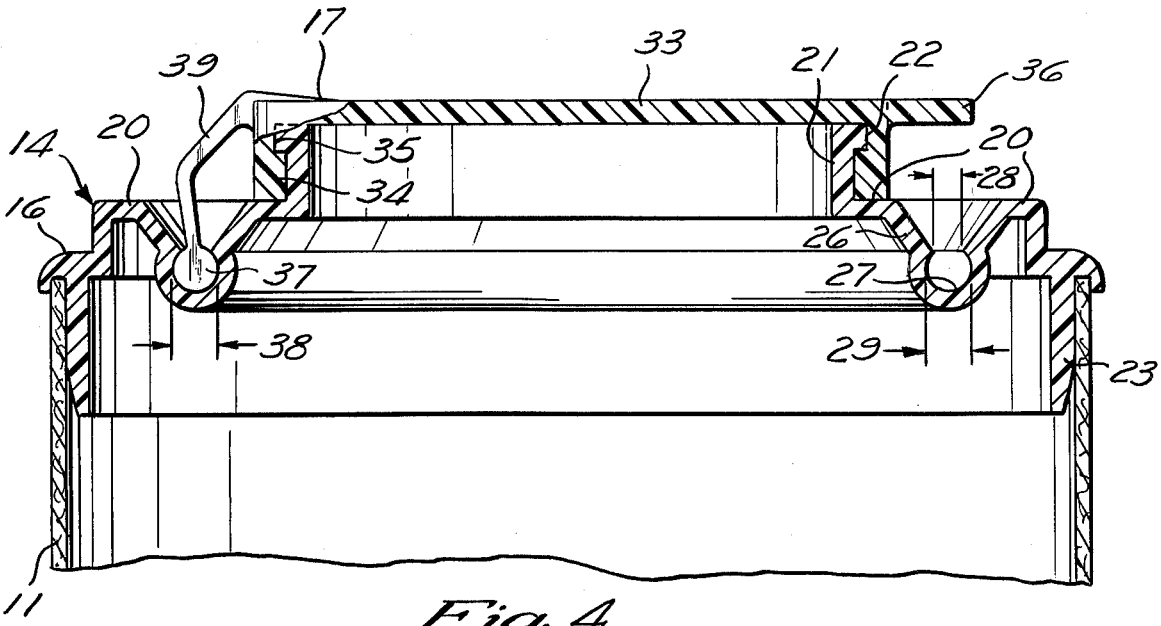
Fig. 4

Fig. 5
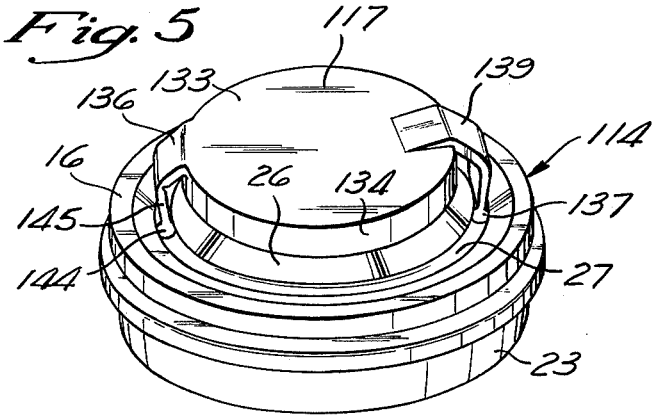
Fig. 6
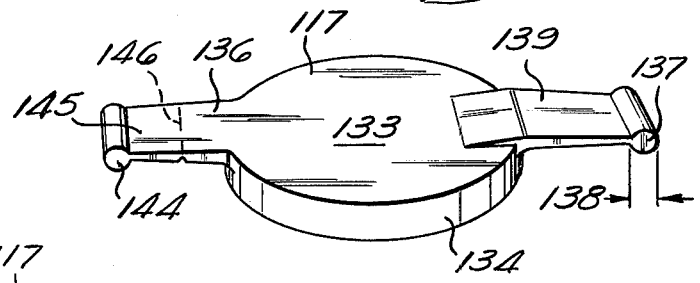
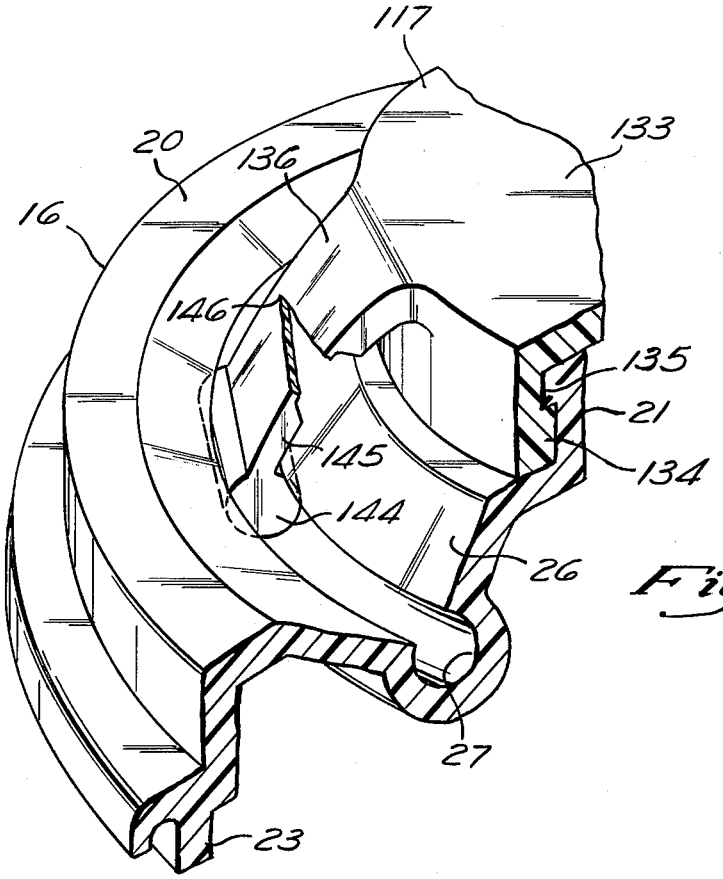
Fig. 7

TWO-PIECE END CLOSURE WITH ASSEMBLY DEVICE

BACKGROUND AND SUMMARY OF THE INVENTION

The present invention relates generally to end closures for containers, and more particularly to two-piece end closures which include a stationary base and a recloseable cap.

Prior art end closures having a stationary base and a recloseable cap may be integrally molded as a single piece, such as shown in U.S. Pat. No. 3,966,080. Alternatively, the base and cap may be made as two separate pieces, such as shown in U.S. Pat. Nos. 2,062,796, 2,069,930, 3,695,481 and 4,000,839.

The present invention departs from these and other prior art end closures by providing a two-piece end closure in which the recloseable cap is secured to the stationary base when the cap is open to prevent loss of the cap. The cap can be attached to the base in an assembly operation without having to rotationally orient the cap relative to the base.

The stationary base includes a through opening for dispensing the contents of the container and an annular trough extending substantially 360° around the opening. The recloseable cap includes a disc shaped cover portion which extends over the opening of the base. An elongated attachment lug is connected to the cover portion by a flexible connecting wall extending between the cover portion and the lug. The lug is frictionally received at any circumferential location in the annular trough, so that the lug is received in the trough during assembly without requiring rotational orientation of the cap relative to the base. When the cap is in the open position, the lug and connecting wall retain the cap on the base so that it will not be misplaced.

In a second embodiment, the invention also provides a second attachment lug radially opposite the first attachment lug. The second attachment lug is connected to the cover portion by a second connecting wall. The second connecting wall includes a reduced thickness frangible tear section which may be broken when the cap is initially opened. In this manner, the second lug and second connecting wall assure that the cap cannot be opened prior to purchase without the torn portion providing a visual indication to the purchaser that the end closure has already been opened.

BRIEF DESCRIPTION OF THE DRAWINGS

These and other aspects and advantages of the invention will be more readily apparent from the following explanation of the drawings, wherein:

FIG. 1 is a perspective view of a first embodiment of an end closure according to this invention mounted on a closed end cylindrical container;

FIG. 2 is an enlarged perspective view of the end closure shown in FIG. 1, but with the cap shown in an open position;

FIG. 3 is a perspective view of the cap for the end closure shown in FIG. 1;

FIG. 4 is an enlarged cross-sectional side-elevational view taken along reference line 4—4 of FIG. 1;

FIG. 5 is a perspective view of an end closure according to a second embodiment of the invention;

FIG. 6 is a perspective view of the cap for the end closure shown in FIG. 5 before the cap is attached to the base; and FIG. 7 is an enlarged partial perspective view of the end closure shown in FIG. 5, but with the second connecting wall shown in a partially torn configuration.

DETAILED DESCRIPTION OF THE DRAWINGS

Referring now to the drawings in greater detail, FIG. 1 is a perspective view of a dispensing container having an end closure according to the principals of the invention. The dispensing container shown in FIG. 1 includes a paper fiber tube 11 and a bottom end closure 12. A top end closure 14 closes the top end of the container during shipping and storage and provides a means for dispensing the contents of the container. The end closures 12 and 14 in the preferred embodiment are secured on the ends of the fiber tube 11 by glue. In actual use, one of the end closures is first secured on the fiber tube 11 to form an open ended can, the can which is so formed is filled with a product which is to be dispensed, and the other end closure is then secured on the open end of the can.

FIGS. 2 through 4 show the top end closure 14 in greater detail. The end closure 14 includes a stationary base 16 and a recloseable cap 17 which is permanently frictionally retained on the base 16. The base 16 and the cap 17 are each injection molded and are assembled after they are molded in a manner described below.

As best shown in FIG. 4, the stationary base 16 includes an annular top wall 20 having an opening extending axially through its center and a cylindrical dispensing wall 21 through which the contents of the container are dispensed. A sealing and detent surface 22 is provided around the entire periphery of the dispensing wall 21 to retain the cap 17 in a closed position and to seal against leakage, as described further below. An annular skirt portion 22 extends axially downwardly from the radially outward portion of the top wall 20 and is received within the end of the fiber tube 11.

Referring still to FIG. 4, a tapered entrant throat 26 extends axially downwardly from the top wall 20 to a trough 27. The throat 26 and trough 27 each extend 360° circumferentially around the top wall 20 and dispensing wall 21. The trough 27 has a continuous annular top opening facing axially upwardly and having a predetermined maximum radial width 28. The trough 27 also includes radially facing arcuate side walls which are spaced apart a predetermined maximum distance 29 which is greater than the width 28 of the open top of the trough 27. This lateral cross-sectional configuration of the trough 27 is the same around the entire circumferential extent of the trough 27.

The structure of the recloseable cap 17 is shown in FIGS. 3 and 4. The cap 17 includes a disc shaped cover wall 33, which extends laterally over the opening in the base 16. A continuous annular skirt 34 extends axially downwardly from the cover wall 33. The skirt 34 includes a sealing and detent surface 35 which cooperates with the surface 22 of the base 16 to hold the cap 17 in its closed position and to seal against leakage of the contents of the container. The cap 17 also includes a lip 36 which is conveniently grasped by the fingers of the user to move the cap 17 between a partially open position shown in FIG. 2 and a closed position shown in FIG. 4 and a fully open position (not shown) in which the cap 17 is rotated 180° counterclockwise from the closed position shown in FIG. 4.

The cap 17 also includes a cylindrical attachment lug 37. The lug 37 has a predetermined maximum radial width 38 which is greater than the width 28 of the opening of the trough 27. The lug 37 extends circumferentially through an arc no greater than 45° and preferably no greater than 20° in the annular trough 27. A flexible connecting wall 39 connects the lug 37 to the cover wall 33.

After the base 16 and the cap 17 have been manufactured, the cap 17 may easily be permanently attached to the base 16. This is accomplished by aligning the center of the cap skirt portion 34 with the center of the base dispensing wall 21 and applying a force against the top of the cover wall 33 to push the skirt portion 34 onto the dispensing wall 21. At the same time as the skirt portion 34 is being pushed over the dispensing wall 21, the attachment lug 37 is pushed axially into the trough 27. When this occurs, the entrant throat 26 in the base guides the attachment lug 37 and aligns the attachment lug 37 with the open top of the trough 27. Because the width 38 of the attachment lug 37 is greater than the width 28 of the open top of the trough 27, the attachment lug 37 snaps into the trough 27 with an interference fit and permanently mechanically secures the cap 17 to the base 16 without the use of adhesives or other bonding agents. The base 16 may be made of a medium impact styrene, while the cap 17 may be made of a flexible polyethylene. This provides a stationary base which is rigid and a recloseable cap which is flexible so that the cap can be snapped onto the base as described without breakage. Alternatively, the base 16 and cap 17 may be made of any other suitable material as may be readily selected by those skilled in the art.

Referring now to FIGS. 5 through 7, a second embodiment of the invention is shown. In the second embodiment, the end closure includes the stationary base 16 described above and a recloseable cap 117. The end closure according to the second embodiment is adapted for use in the paper fiber tube 11 shown in FIG. 1.

The recloseable cap 117 includes a cover wall 133, a skirt portion 134, a sealing and detent surface 135, a lip 136, an attachment lug 137 having a predetermined maximum radial width 138, and a flexible connecting wall 139. All of these portions of the cap 117 are identical in structure and operation to the corresponding parts of the cap 17 shown in FIGS. 1 through 4 and discussed above.

In addition to these components, the cap 117 also includes a second attachment lug 144. The second attachment lug 144 is secured to the lip 136 by a second flexible connecting wall 145 and by a reduced thickness frangible tearing strip 146. When the cap 117 is assembled on the base 16, the attachment lug 144 is snapped into the trough 27 at a location spaced 180° from the first attachment lug 137. The second attachment lug 144 is preferably snapped into the trough 27 at the same time as the first attachment lug 137 is snapped into the trough. Again, this structure permits the cap 117 to be assembled on the stationary base 16 without having to rotationally orient the cap 117 relative to the base 16.

Because the cap 117 is secured in place by the two oppositely spaced lugs 137 and 144 and connecting walls 139 and 145, the cap 117 cannot be opened until the frangible tear strip 146 is broken. This may be accomplished by the user inserting a finger or a tool such as a spoon handle or knife between the tearing strip 146 and the entrant throat 26. After the tearing strip 146 is broken, the user can manually grasp the lip 136 and pull the cap 117 upwardly to open the end closure. In this manner, the second embodiment of the invention provides a visual indication to the purchaser that the end closure has not been opened prior to purchase, since the initial opening of the end closure requires breaking the frangible strip 146. After the strip 146 is broken, the cap 117 is closed and reopened in the manner described above with respect to the cap 17.

What is claimed is:

1. A two piece end closure for a container comprising a stationary base and a recloseable cap; said base including a through opening for dispensing the contents of the container and a continuous open trough extending in a circular path completely around said opening; said cap including a cover extending over said opening, and a lug attached to said cover and frictionally received in said trough.

2. A two piece end closure as set forth in claim 1, said cap including a flexible connecting wall extending between said cover and said lug.

3. A two piece end closure as set forth in claim 2, said base including an annular top wall through which said opening extends, and said trough depending from said top wall.

4. A two piece end closure as set forth in claim 3, said base including an annular skirt portion for being received in said container, said trough being disposed between said skirt portion and said opening.

5. A two piece end closure as set forth in claim 4, said base including a tapered entrant throat extending between said top wall and said trough.

6. A two piece end closure as set forth in claim 1, said cap including a second attachment lug frictionally received in said trough, a second connecting wall extending between said cover and said second lug, and said second connecting wall including a reduced thickness frangible tear section.

7. A two piece end closure as set forth in claim 6, said first and second attachment lugs being circumferentially spaced approximately 180° apart.

8. A two piece end closure and a container; said end closure including a stationary base disposed on said container and a recloseable cap; said base including a top wall, a through opening in said top wall for dispensing the contents of said container, and means extending substantially 360° around said opening for hingedly securing said cap to said base; said cap including a cover extending over said opening, and means extending less than 20° around said opening frictionally secured to said first mentioned means; said first mentioned means being an open trough and said second mentioned means being a lug received in said trough.

9. A two piece end closure for a container comprising a base and a cap; said base including an annular skirt portion for being received in a container, a through opening for dispensing the contents of the container, and an annular trough extending substantially 360° around said opening, said annular trough having an annular open top of predetermined maximum radial width and having radially facing side walls separated by a maximum radial distance greater than said maximum radial width of said open top; said cap including a cover portion extending over said opening, and a lug, said lug having a maximum width greater than said maximum width of said open top of said recess, and said lug being frictionally received in said recess, whereby said cap may be assembled on said base when said cap is in any rotational orientation relative to said base.

10. A two piece end closure as set forth in claim 9, wherein said cap includes a flexible connecting wall, and said connecting wall extends between said lug and said cover portion.

11. A two piece end closure as set forth in claim 10, wherein said cap and said base include detent means holding said cap in a closed position relative to said base, and said annular trough extends substantially 360° around said detent means.

* * * * *